US005503402A

United States Patent [19]

Moss, Jr.

[11] Patent Number: 5,503,402

[45] Date of Patent: Apr. 2, 1996

[54] SOCCER PRACTICE FOCAL DEVICE

[76] Inventor: Norman R. Moss, Jr., 2270 Fawn Dr., Arnold, Mo. 63010

[21] Appl. No.: 408,376

[22] Filed: Mar. 22, 1995

[51] Int. Cl.[6] ..... A63B 63/00

[52] U.S. Cl. ..... 273/400; 273/402; 273/411

[58] Field of Search ..... 273/398, 400, 273/402, 411

[56] References Cited

U.S. PATENT DOCUMENTS

| | | | |
|---|---|---|---|
| 3,810,616 | 5/1974 | Murphy | 273/402 X |
| 3,856,298 | 12/1974 | Franttti | 273/402 X |
| 4,245,843 | 1/1981 | Griggs | 273/411 X |
| 4,545,210 | 2/1987 | Patsy | 273/411 X |
| 4,592,547 | 6/1986 | Thaxton | 273/402 X |
| 4,700,952 | 10/1987 | Patsy | 273/411 X |
| 4,826,166 | 5/1989 | Baker et al. | 273/402 X |
| 4,921,257 | 5/1990 | Heller | 273/401 |
| 4,948,147 | 8/1990 | Pallanca | 273/402 |
| 5,181,725 | 1/1993 | Leras et al. | 273/402 |
| 5,271,624 | 12/1993 | Sciortino | 273/411 |
| 5,290,043 | 3/1994 | Vidinic | 273/411 |

*Primary Examiner*—William H. Grieb
*Attorney, Agent, or Firm*—Kevin L. Klug

[57] ABSTRACT

A soccer practice focal device removably attached to both a cross-member bar and an upright post of a conventional soccer goal. The soccer practice focal device in combination with the soccer goal defining a focal area for a soccer player to mentally focus on and attempt to shoot a soccer ball through. The soccer practice device is adapted for quick installation and removal from a soccer goal thereby allowing the device to be utilized immediately before a soccer game when practice and mental concentration are most crucial. The soccer practice device also provides for minimal interference with the soccer goalie during practice.

23 Claims, 5 Drawing Sheets

FIG. 4
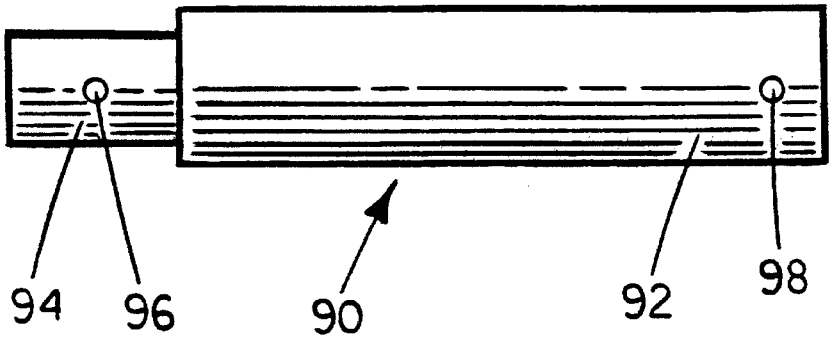
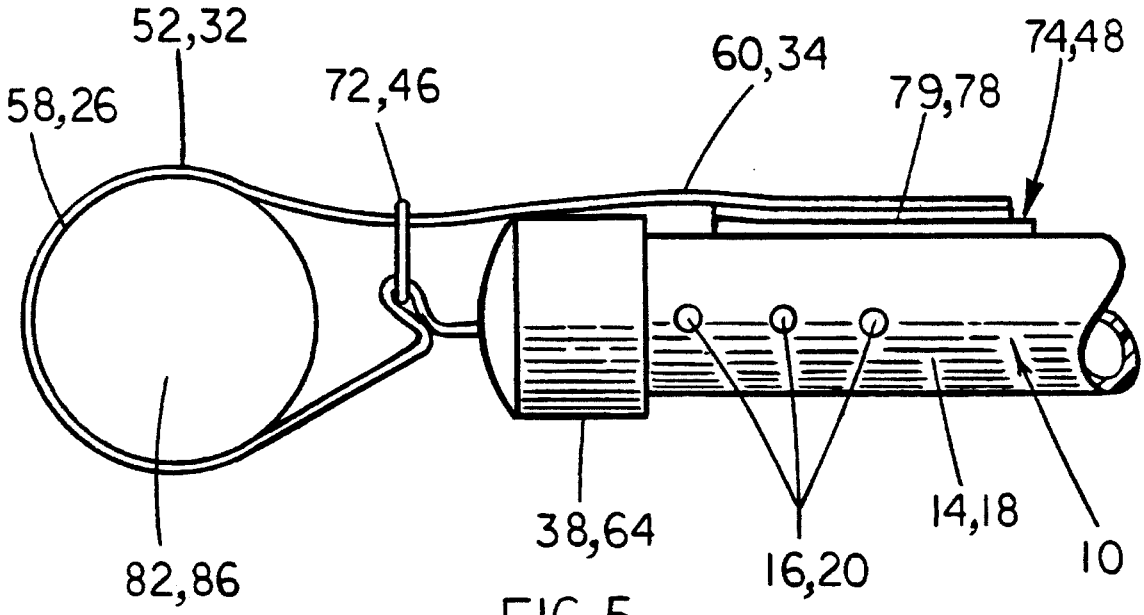
FIG. 5
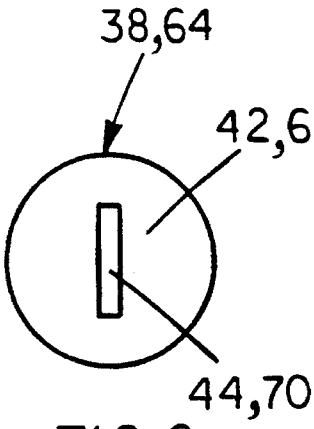
FIG. 6
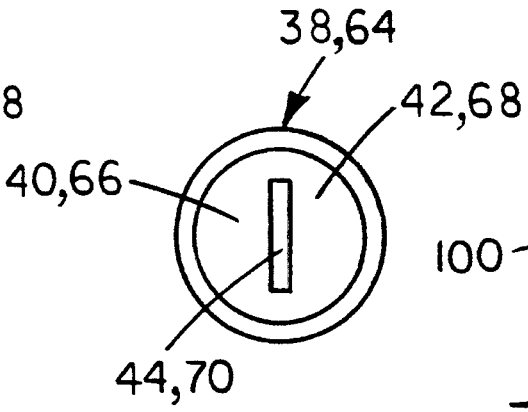
FIG. 7
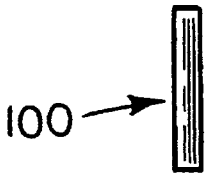
FIG. 8

SOCCER PRACTICE FOCAL DEVICE

BACKGROUND OF THE INVENTION

The present invention relates in general to focal devices and pertains, more particularly, to a focal device for use with a conventional soccer goal. The focal device of this invention is an improvement over conventional focus devices.

With conventional focal devices it is generally necessary to attach the device to the soccer goal in such a manner as to require considerable time and effort. As such, it is difficult to utilize the conventional device immediately prior to a soccer game because of the effort required for both attachment and removal of the device. Additionally, it is impossible and/or impractical for a goalie to fully use and occupy the goal when using traditional soccer targeting devices.

Accordingly, it is an object of the present invention to provide an improved soccer practice focal device that is adapted for quick installation and removal from a soccer goal thereby allowing the device to be utilized immediately before a soccer game when practice and mental concentration are most crucial.

Another object of the present invention is to provide an improved soccer practice focal device which is attached to the soccer goal in such a manner as to not hinder the play of the soccer goalie in practice or pre-game warm up.

A further object of the present invention is to provide an improved soccer practice focal device which is attached to the soccer goal in such a manner as to withstand a direct hit by a soccer ball and still remain firmly attached to the soccer goal.

Still another object of the present invention is to provide an improved focal device which is adjustable thereby allowing a player to vary the size of a focal area defined by the soccer practice device and the soccer goal as the player's age, size, or skill changes.

Still a further object of the present invention is to provide an improved focal device which has receiving means for catching a soccer ball passing within the focal area.

SUMMARY OF THE INVENTION

To accomplish the foregoing and other objects of this invention there is provided a soccer practice focal device attached to both a cross-member bar of the soccer goal and an upright post of the soccer goal for use as a focal unit. The soccer practice focal device comprises a substantially L-shaped member removably attached to the soccer goal and fastening means for removably attaching the substantially L-shaped member to the soccer goal. The substantially L-shaped member in combination with the soccer goal defines a focal area which a player mentally focuses on and attempts to shoot a soccer ball though. A typical configuration utilizes two of the soccer practice focal devices in each soccer goal, with one of the devices being located in each upper left and right corner of the soccer goal.

In the preferred embodiment described herein, the substantially L-shaped member has a first-end portion having a plurality of apertures for receiving a first pin and a second-end portion having a plurality of apertures for receiving a second pin. The plurality of apertures of both the first-end portion and the second-end portion are not all utilized but merely provide a player with the ability to adjust the size of the focal area by physically shortening the substantially L-shaped member, thereby removing some of the plurality of apertures but still allowing the pin to be received. The L-shaped member may also be lengthened by means of an extender tube which utilizes the existing apertures and pin attaching means.

Also, in the preferred embodiment, the fastening means comprises at least one fastening assembly comprising a strap having an end portion with a loop for receiving the pin, an intermediate portion, and an opposite end portion; a cup having an open end for receiving the end portion of the substantially L-shaped member and a partially closed end with a slot for receiving the intermediate portion of the strap; a retaining ring; and attachment means for removably attaching the substantially L-shaped member to the soccer goal. Preferably, the attachment means comprises hook and loop type fasteners which are commonly known by the VELCRO trademark.

In an alternate embodiment, the soccer practice focal device further comprises receiving means for catching a soccer ball which passes through the focal area. Preferably, the receiving means comprises a net.

The soccer practice focal device can be manufactured of different materials, sizes and colors. In the preferred embodiment described herein the soccer practice focal device comprises non-metallic tubular pipe.

BRIEF DESCRIPTION OF THE DRAWINGS

Numerous other objects, features and advantages of the invention should now become apparent upon a reading of the following detailed description taken in conjunction with the accompanying drawings, in which:

FIG. 4 is a plan view of the extension tube;

FIG. 5 is an end view and/or bottom view of the preferred embodiment of the soccer practice device;

FIG. 6 is an end view of the cup of at least one fastening assembly of the preferred embodiment of the soccer practice device;

FIG. 7 is an opposite end view of the cup of at least one fastening assembly of the preferred embodiment of the soccer practice device;

FIG. 8 is a plan view of the extension tube self holding extension pin;

DETAILED DESCRIPTION

Figure 1:
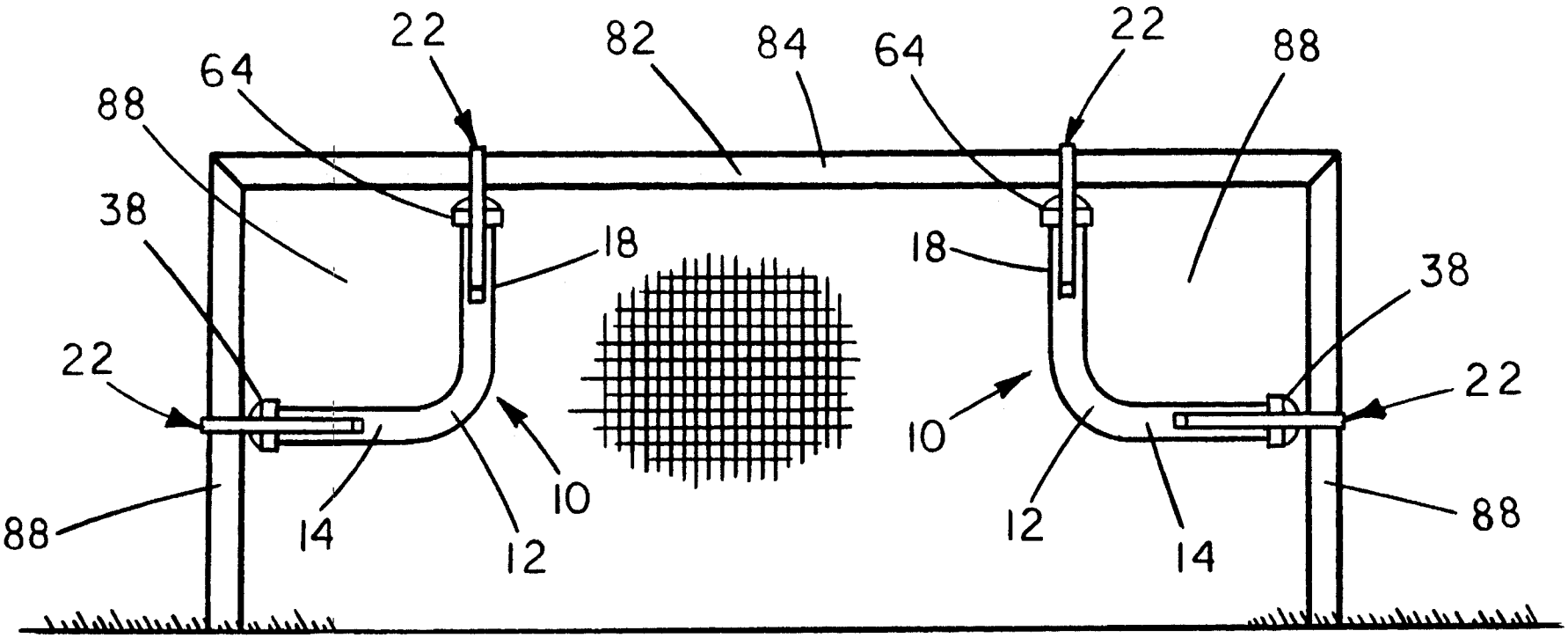
FIG. 1 is a perspective view of a preferred embodiment of the soccer practice focal device shown attached to a soccer goal.
Figure 2:
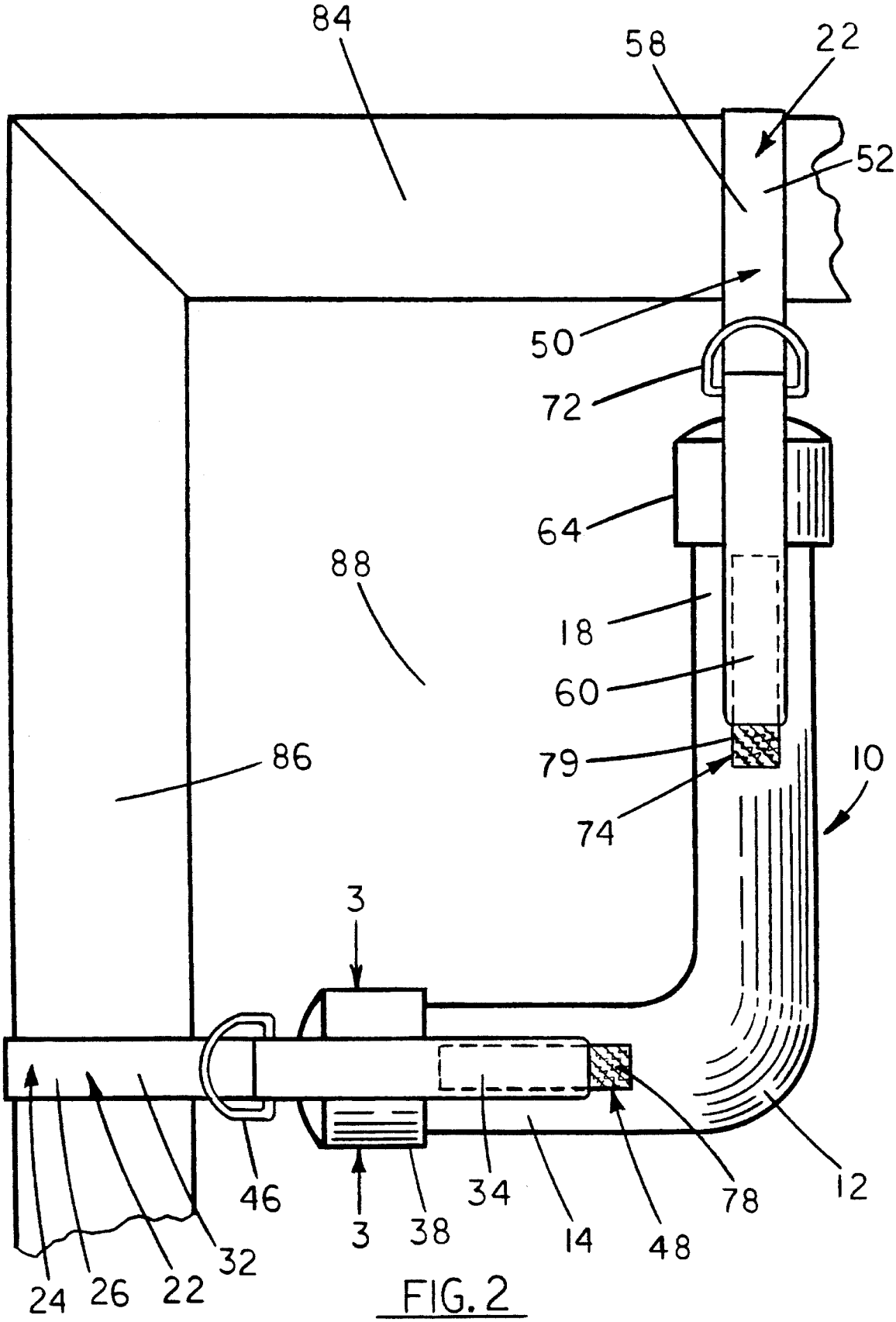
FIG. 2 is a plan view of the preferred embodiment of the soccer practice focal device.
Figure 3:
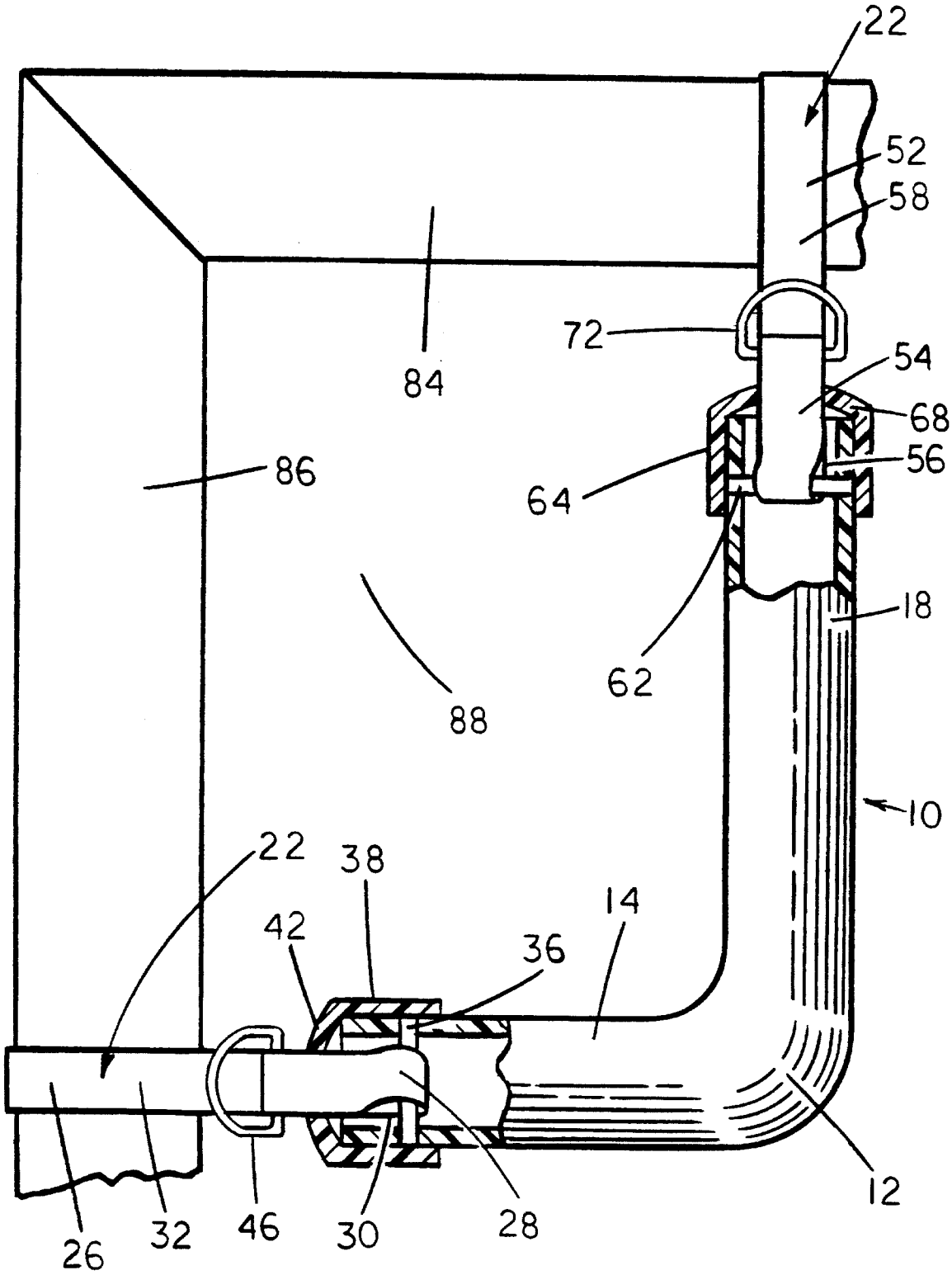
FIG. 3 is a cross-sectional view of the preferred embodiment of the soccer practice focal device taken along line 3—3 in FIG. 2.

Referring now to the drawings there is shown a preferred embodiment in FIGS. 1–9 of the soccer practice focal device of this invention. The soccer practice focal device is described in connection with a conventional soccer goal. The soccer practice focal device of the present invention is particularly adapted for attachment to the soccer goal in such a manner as to not hinder the play of the soccer goalie in practice or pre-game warm up while also providing for quick installation and removal from the soccer goal.

The drawings show the soccer practice focal device 10 in conjunction with a soccer goal 82 having a cross-member bar 84 and upright posts 86. The soccer practice focal device 10 comprises a substantially L-shaped member 12 and fastening means 22 for removably attaching the substantially L-shaped member 12 to the soccer goal 82.

In a preferred embodiment, the substantially L-shaped member 12 comprises a first end portion 14 having a plurality of apertures 16 for receiving a, first pin 36 and a second-end portion 18 having a plurality of apertures 20 for receiving a second pin. The substantially L-shaped member 12 in combination with the cross-member bar 84 and an upright post 86 defining a focal area 88 for a player to mentally focus on and attempt to shoot a soccer ball through.

Also in the preferred embodiment, the fastening means 22 comprises at least one fastening assembly, preferably a first fastening assembly 24 and a second fastening assembly 50. The first fastening assembly 24 of the preferred embodiment comprises a first strap 26 having an end portion 28 with a first loop 30 for receiving the first pin 36, an intermediate portion 32, and an opposite end portion 34; a first cup 38 having an open end 40 for receiving the first end portion 14 of the substantially L-shaped member 12 and a partially closed end 42 with a first slot 44 for receiving the intermediate portion 32 of the first strap 26; a first retaining ring 46, securely attached to the intermediate portion 32, further receiving the intermediate portion 32 of the first strap 26; and first attachment means 48 for removably attaching the opposite end portion 34 of the first strap 26 to the first end portion 14 of the substantially L-shaped member 12 such that the intermediate portion of the first strap 32 contacts the upright post 86 of the soccer goal 82 after being received by the first retaining ring 46.

The preferred second fastening assembly 50 comprises a second strap 52 having an end portion 54 with a second loop 56 for receiving a second pin 62, an intermediate portion 58, and an opposite end portion 60; a second cup 64 having an open end 66 for receiving the second end portion 18 of the substantially L-shaped member 12 and a partially closed end 68 with a second slot 70 for ,receiving the intermediate portion 58 of the second strap 52; a second retaining ring 72, securely attached to intermediate portion 58, further receiving the intermediate portion 58 of the second strap 52; and second attachment means 74 for removably attaching the opposite end portion 60 of the second strap 52 to the second end portion 18 of the substantially L-shaped member 12 such that the intermediate portion 58 of the second strap 52 contacts the cross-member bar 84 of the soccer goal 82 after being received by the second retaining ring 72.

In a preferred embodiment, both the first and second attachment means 48, 74 comprise hook and loop type fasteners 78, 79, commonly known by the VELCRO tradmark. Additionally, the substantially L-shaped member 12 is preferably comprised of tubular pipe having an approximately 2.00 inch diameter. The tubular pipe may be comprised of either metallic or non-metallic material. The strap of at least one fastening assembly may be comprised of either a substantially rigid material or a substantially resilient material. Preferably, the strap comprises a synthetic fibrous material, such as nylon.

Figure 9:
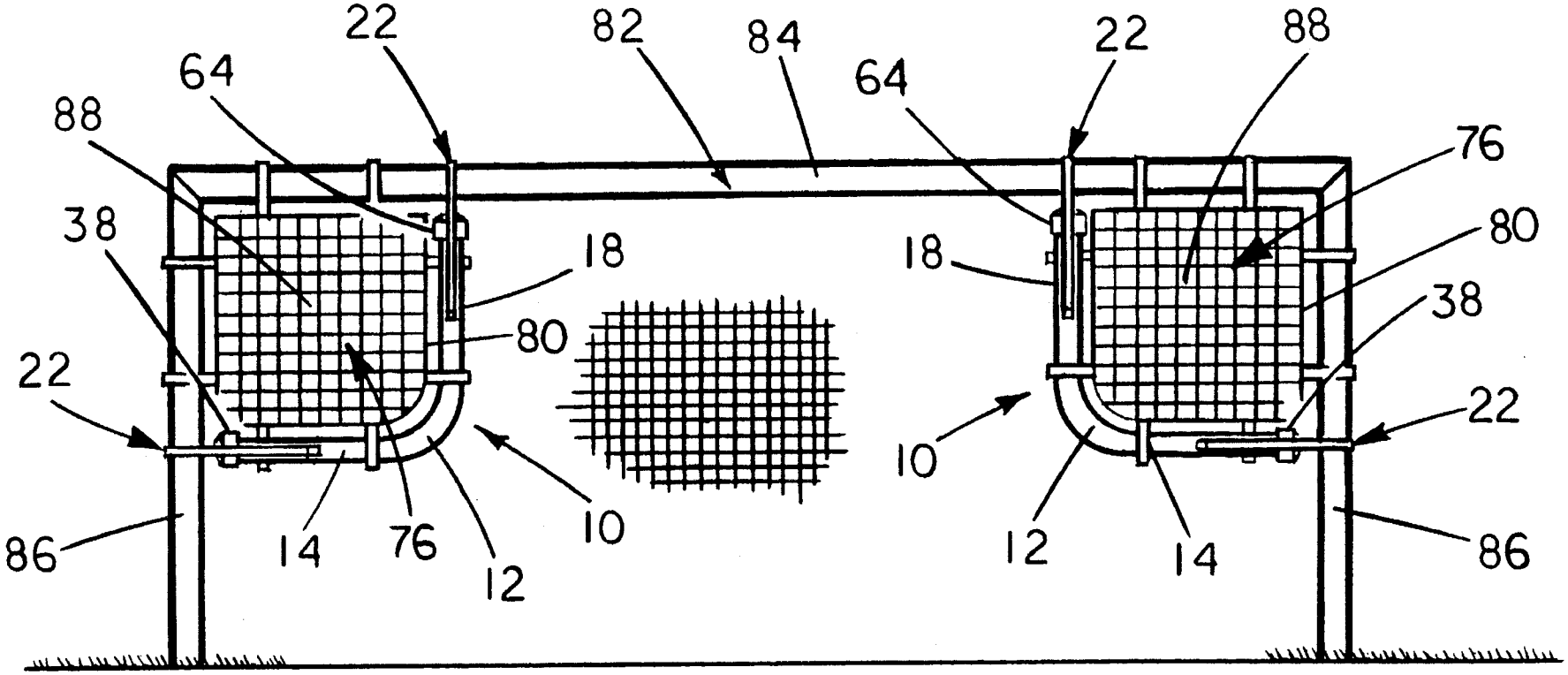
FIG. 9 is a perspective view of an alternate embodiment of the soccer practice focal device with receiving means attached to the soccer goal.

FIG. 9 shows an alternate embodiment of the soccer practice device 10 further comprising receiving means 76 removably attached to both the soccer practice device 10 and the soccer goal 82. Preferably, the receiving means 76 comprises a net 80.

In operation, a player adjusts the size of the focal area 88 by removing a portion, including some of the plurality of apertures, of either the first-end portion 14 of the substantially L-shaped member 12 or the second-end portion 18 of the substantially L-shaped member 12 or by removing a portion, including some of the plurality of apertures, of both the first-end portion 14 and the second-end portion 18.

After the size of the first-end portion 14 of the substantially L-shaped member 12 is adjusted for the player s age, size, and/or skill, the soccer practice focal device 10 is assembled and attached to the soccer goal 82 by placing the first pin 36 through the first loop 30 of the end portion 28 of the first strap 26 and then placing the first pin 36 through one of the plurality of apertures 16 thereby securely attaching the end portion 28 of the first strap 26 to the first-end portion 14 of the substantially L-shaped member 12.

The opposite end portion 34 of the first strap 26 is first passed through the open end 40 of the first cup 38 and then through the first slot 44 of the partially closed end 42 of the first cup 38 until the intermediate portion 32 of the first strap 26 is received within the first slot 44. The first-end portion 14 of the substantially L-shaped member 12 is received by the open end 40 of the first cup 38 thereby removably attaching, via a friction fit, the first cup 38 to the first end portion 14 of the substantially L-shaped member 12 and thereby covering and securing first pin 36.

Next, the opposite end portion 34 of the first strap 26 is passed through the first retaining ring 46 until the intermediate portion 32 of the first strap 26 is received within the first retaining ring 46. Then the opposite end portion 34 of the first strap 26 is looped around the upright post 86 of the soccer goal 82 and pulled tight until the intermediate portion 32 of the first strap 26 contacts the upright post 86 of the soccer goal 82.

Finally, the opposite end portion 34 of the first strap 26 is passed back through the first retaining ring 46 until another part of the intermediate portion 32 of the first strap 26 is in contact with the first retaining ring 46. Then, the first attachment means 48, preferably hook and loop type fasteners 78, attaches the opposite end portion 34 of the first strap 26 to the first-end portion 14 of the substantially L-shaped member 12 thereby removably attaching the soccer practice focal device 10 to the soccer goal 82.

If the size of the second-end portion 18 of the substantially L-shaped member 10 requires adjustment for the player's age, size, and/or skill, it is adjusted, assembled, and then attached in exactly the same manner as just described above for adjusting, assembling, and attaching the first-end portion 14 of the substantially L-shaped member 12.

Namely, after the size of the second-end portion 18 of the substantially L-shaped member 12 is adjusted for the player's age, size, and/or skill, the soccer practice focal device 10 is assembled and attached to the soccer goal 82 by placing the second pin 62 through the second loop 56 of the end portion 54 of the second strap 52 and then placing the second pin 62 through one of the plurality of apertures 20 thereby securely attaching the end portion 54 of the second strap 52 to the substantially L-shaped member 12.

The opposite end portion 60 of the second strap 52 is first passed through the open end 66 of the second cup 64 and then through the second slot 70 of the partially closed end 68 of the second cup 64 until the intermediate portion 58 of the second strap 52 is received within the second slot 70. The second-end portion 18 of the substantially L-shaped member 12 is received by the open end 66 of the second cup 64 thereby removably attaching, via a friction fit, the second cup 64 to the second-end portion 18 of the substantially L-shaped member 12, and thereby covering and securing second pin 62.

Next, the opposite end portion 60 of the second strap 52 is passed through the second retaining ring 72 until the intermediate portion 58 of the second strap 52 is received within the second retaining ring 72. Then the opposite end portion 60 of the second strap 52 is looped around the cross-member bar 84 of the soccer goal 82 and pulled tight until the intermediate portion 58 of the second strap 52 contacts the cross-member bar 84 of the soccer goal 82.

Finally, the opposite end portion 60 of the second strap 52 is passed back through the second retaining ring 72 until another part of the intermediate portion 58 of the second strap 52 is in contact with the second retaining ring 72. Then, the second attachment means 74, preferably hook and loop type fasteners 79, attaches the opposite end portion 60 of the second strap 52 to the second-end portion 18 of the substantially L-shaped member 12 thereby removably attaching the soccer practice focal device 10 to the soccer goal 82.

Further expansion adjustment is provided by an extension tube 90 by insertion of the first extender end 94 into the first-end portion 14 and/or the second-end portion 18 of the substantially L-shaped member 12 and inserting the self holding extender pin 100 into and through the first extender hole 96 and one of the plurality of apertures 16, 20 of the first-end portion 14 and/or the second-end portion 18 respectively. Attachment to the soccer goal is achieved with the use of the previously described first fastening assembly 24 and/or second fastening assembly 50 together with the first cup 38 and/or the second cup 64 respectively by attachment to the second extender end 92 by insertion of the first pin 36 and/or the second pin 62 respectively into and through the second extender hole 98 and through the first fastening assembly 24 and/or the second fastening assembly 50 respectively, with placement of the first cup 38 and/or the second cup 64 and the complete first fastening assembly 24 and/or the second fastening assembly 50 respectively, exactly as previously described with the first-end portion 14 and/or the second-end portion 18 of the substantially L-shaped member 12.

In the event, that the focal area 88 of the soccer practice device 10 does not have to be adjusted for the player's age, size, and/or skill, the soccer practice device 10 is assembled and attached to the soccer goal 82 in exactly the same manner as described above except that the step of removing a portion of the substantially L-shaped member 12 is no longer necessary. Once the soccer practice device 10 is assembled, it can be attached, removed, and reattached without the need to disassemble and reassemble each time, unless the focal area 88 requires adjustment In the alternate embodiment shown in FIG. 9, a portion of the receiving means 76 would be removably attached to the soccer practice device 10 prior to attaching the device to the soccer goal 82 and another portion of the receiving means 76 would be attached to the soccer goal 82 after the soccer practice device 10 is attached to the soccer goal 82.

From the foregoing description those skilled in the art will appreciate that all objects of the present invention are realized. A soccer practice focal device has been shown and described which permits attachment to the soccer goal in such a manner as to not hinder the play of the soccer goalie in practice or pre-game warm up while also providing for quick installation and removal from the soccer goal.

The device of this invention is able to withstand a direct hit from a soccer ball and still remain firmly attached to the soccer goal. The preferred design of the present invention, as well as alterations that will now be apparent to those skilled in the art, all allow use of the device with any conventional soccer goal. The tool of this invention is further characterized by the adjustable focal area.

The present invention, in an alternate embodiment, provides for receiving means capable of catching a soccer ball which has passed through the focal area.

Having described the invention in detail, those skilled in the art will appreciate that modifications may be made of the invention without departing from its spirit. Therefore, it is not intended that the scope of the invention be limited to the specific embodiments illustrated and described. Rather it is intended that the scope of this invention be determined by the appended claims and their equivalents.

What is claimed is:

1. A soccer practice device attached to both a cross-member bar and an upright post of a soccer goal for use as a focal unit comprising:

a substantially L-shaped member removably attached to a soccer goal, the substantially L-shaped member in combination with the soccer goal defining a focal area; and fastening means for removably attaching the substantially L-shaped member to the cross-member bar and the upright post.

2. A soccer practice device as set forth in claim 1 further comprising receiving means for catching a soccer ball passing through the focal area.

3. A soccer practice device as set forth in claim 2 wherein the receiving means comprises a net.

4. A soccer practice device as set forth in claim 1 wherein the substantially L-shaped member is adjustable such that the focal area is variable.

5. A soccer practice device attached to both a cross-member bar and an upright post of a soccer goal for use as a focal unit comprising:

a substantially L-shaped member comprising a first-end portion and a second-end portion, the substantially L-shaped member removably attached to both a cross-member bar and an upright post of a soccer goal, the substantially L-shaped member in combination with the cross-member bar and the upright post defining a focal area; and at least one fastening assembly comprising a strap, a cup, a retaining ring, and attachment means for removably attaching the substantially L-shaped member to the soccer goal.

6. A soccer practice device as set forth in claim 5 wherein the strap comprises an end portion with a loop for receiving a pin, an intermediate portion, and an opposite end portion; and wherein the cup comprises an open end for receiving the end portion of the substantially L-shaped member and a partially closed end with a slot for receiving the intermediate portion of the strap.

7. A soccer practice device as set forth in claim 5 wherein both the first-end portion of the substantially L-shaped member and the second-end portion of the substantially L-shaped member have a plurality of apertures for receiving the pin of at least one fastening assembly.

8. A soccer practice device as set forth in claim 5 further comprising receiving means for catching a soccer ball passing through the focal area.

9. A soccer practice device as set forth in claim 8 wherein the receiving means comprises a net.

10. A soccer practice device as set forth in claim 7 wherein the substantially L-shaped member is adjustable such that the focal area is variable.

11. A soccer practice device as set forth in claim 10 wherein the substantially L-shaped member is adjustable with an extension tube.

12. A soccer practice device as set forth in claim 5 wherein the substantially L-shaped member comprises tubular pipe.

13. A soccer practice device as set forth in claim 5 wherein the attachment means comprises hook and loop type fasteners.

14. A soccer practice device attached to both a cross-member bar and an upright post of a soccer goal for use as a focal unit comprising:

a substantially L-shaped member comprising a first end portion having a plurality of apertures for receiving a first pin and a second-end portion having a plurality of apertures for receiving a second pin, the substantially L-shaped member removably attached to both a cross-member bar and an upright post of a soccer goal, the substantially L-shaped member in combination with the cross-member bar and the upright post defining a focal area;

a first fastening assembly comprising a first strap having an end portion with a first loop for receiving a first pin, an intermediate portion, and an opposite end portion; a first cup having an open end for receiving the first end portion of the substantially L-shaped member and a partially closed end with a first slot for receiving the intermediate portion of the first strap; a securely attached first retaining ring receiving the intermediate portion of the first strap; and first attachment means for removably attaching the opposite end portion of the first strap to the first end portion of the substantially L-shaped member such that the intermediate portion of the first strap contacts the upright post of the soccer goal after being received by the first retaining ring; and a second fastening assembly comprising a second strap having an end portion with a second loop for receiving a second pin, an intermediate portion, and an opposite end portion; a second cup having an open end for receiving the second end portion of the substantially L-shaped member and a partially closed end with a second slot for receiving the intermediate portion of the second strap; a securely attached second retaining ring receiving the intermediate portion of the second strap; and second attachment means for removably attaching the opposite end portion of the second strap to the second end portion of the substantially L-shaped member such that the intermediate portion of the second strap contacts the cross-member bar of the soccer goal after being received by the second retaining ring.

15. A soccer practice device as set forth in claim 14 further comprising receiving means for catching a soccer ball passing through the focal area.

16. A soccer practice device as set forth in claim 15 wherein the receiving means comprises a net.

17. A soccer practice device as set forth in claim 14 wherein the substantially L-shaped member is adjustable such that the focal area is variable.

18. A soccer practice device as set forth in claim 17 wherein the substantially L-shaped member is adjustable with an expansion tube.

19. A soccer practice device as set forth in claim 14 wherein the substantially L-shaped member comprises tubular pipe.

20. A soccer practice device as set forth in claim 14 wherein both the first attachment means and the second attachment means comprise hook and loop type fasteners.

21. A method for practicing soccer with a soccer practice device for use as a focal unit, the steps comprising:

attaching a soccer practice device comprising a substantially L-shaped member and fastening means to a soccer goal;

forming a focal area defined by the substantially L-shaped member, a cross-member bar of the soccer goal, and an upright post of the soccer goal;

utilizing the focal area as a reference; and kicking a soccer ball through the focal area.

22. A method for practicing soccer with a focal unit as set forth in claim 21, the steps further comprising:

attaching a receiving means for catching a soccer ball passing through the focal area.

23. A method for practicing soccer with a focal unit as set forth in claim 21, the steps further comprising:

varying the focal area by adjusting the substantially L-shaped member of the soccer practice device.

* * * * *